US009546572B2

(12) United States Patent
Cao et al.

(10) Patent No.: US 9,546,572 B2
(45) Date of Patent: Jan. 17, 2017

(54) GAS TURBINE CASING LOAD SHARING MECHANISM

(71) Applicant: General Electric Company, Schenectady, NY (US)

(72) Inventors: Khoa Dang Cao, Simpsonville, SC (US); Kenneth Damon Black, Travelers Rest, SC (US)

(73) Assignee: General Electric Company, Schenectady, NY (US)

( * ) Notice: Subject to any disclaimer, the term of this patent is extended or adjusted under 35 U.S.C. 154(b) by 662 days.

(21) Appl. No.: 14/034,635

(22) Filed: Sep. 24, 2013

(65) Prior Publication Data

US 2015/0086330 A1 Mar. 26, 2015

(51) Int. Cl.
*F01D 25/26* (2006.01)
*F01D 25/24* (2006.01)

(52) U.S. Cl.
CPC ..... *F01D 25/26* (2013.01); *F01D 25/243* (2013.01); *F05D 2230/64* (2013.01); *F05D 2250/51* (2013.01); *Y10T 29/4932* (2015.01)

(58) Field of Classification Search
CPC ..... F01D 25/24; F01D 25/243; F01D 25/26; F01D 25/265; F01D 25/28; F05D 2230/64
USPC ..... 415/213.1, 214.1
See application file for complete search history.

(56) References Cited

U.S. PATENT DOCUMENTS

| | | | | |
|---|---|---|---|---|
| 2,503,914 | A * | 4/1950 | Linn | F01D 25/24 415/135 |
| 4,023,644 | A | 5/1977 | Cowan et al. | |
| 5,293,775 | A | 3/1994 | Clark et al. | |
| 7,648,564 | B2 | 1/2010 | Chillar et al. | |
| 7,963,095 | B2 | 6/2011 | Chillar et al. | |
| 8,348,200 | B2 | 1/2013 | Saddoughi et al. | |
| 2007/0294984 | A1 | 12/2007 | Chillar et al. | |
| 2008/0298957 | A1 | 12/2008 | Chillar et al. | |
| 2011/0147476 | A1 | 6/2011 | Saddoughi et al. | |
| 2011/0299973 | A1 | 12/2011 | Zhang et al. | |
| 2012/0297599 | A1 | 11/2012 | Sing et al. | |

FOREIGN PATENT DOCUMENTS

| | | |
|---|---|---|
| EP | 2154351 A2 | 2/2010 |
| EP | 2392394 A1 | 12/2011 |

* cited by examiner

*Primary Examiner* — Richard Edgar
(74) *Attorney, Agent, or Firm* — Dority & Manning, P.A.

(57) ABSTRACT

A turbine system is provided having a first turbine casing and a second turbine casing, the first and second turbine casings together defining an inner wall. The turbine system further includes a first attachment flange extending from a surface of the first turbine casing within the inner wall and a second attachment flange extending from a surface of the second turbine casing within the inner wall. The first attachment flange defines a first aperture and the second attachment flange defines a second aperture. A pin extends through the first aperture and into the second aperture.

19 Claims, 4 Drawing Sheets

GAS TURBINE CASING LOAD SHARING MECHANISM

FIELD OF THE INVENTION

The present disclosure relates generally to a turbine system, and more particularly to an attachment assembly for turbine casings of the turbine system.

BACKGROUND OF THE INVENTION

Turbine systems are widely utilized in fields such as power generation. By way of example, a conventional gas turbine system generally includes a compressor, a combustor, and a turbine. Further, a conventional gas turbine includes a rotor with various rotor blades mounted to disks in the compressor and turbine sections thereof. Each blade includes an airfoil over which a pressurized working fluid flows.

During operation of a turbine system, the working fluid, such as air, must be supplied to the system. The working fluid may enter the system through a filter house and flow from the filter house through a duct system and through an inlet casing of the turbine system to, e.g., a compressor. The inlet casing of the turbine system may generally include an inner wall and an outer wall, connected by one or more inlet struts. The inner and outer walls may have a tapered cylindrical shape, such that they define a generally annular inlet duct therebetween. The inlet duct may allow the working fluid to flow from e.g., the filter house and duct system therethrough to the compressor of the turbine system.

The inlet of the turbine system may be assembled as an upper half and a lower half. Generally, the upper and lower halves may be bolted together along an outside surface of the outer wall. Additionally, within the inner wall, at the forward end, or upstream end, the upper half of the inlet may be bolted to the lower half of the inlet. Such a configuration can attach the upper and lower halves of the inlet casing without affecting the aerodynamics of the generally annular inlet duct.

However, due to the space constraints within the inner wall, it may be impractical to use bolts and/or tools to attach the upper and lower halves of the inlet towards the aft end, or downstream end. Accordingly, the turbine system may include one or more dowels extending vertically from the bottom half of the inner wall towards the aft end, the dowels being configured to mate with a corresponding aperture in the upper half of the inner wall.

During operation of the turbine system, however, such a configuration may not be able to efficiently transfer forces exerted on the lower half of the inner wall to the upper half of the inner wall. Accordingly, the forces exerted on the lower half of the inner wall may mainly be transferred to the outer wall through the inlet struts in the lower half of the inlet. The inlet struts in the lower half of the inlet thus may need to be designed to accommodate all of such forces.

Therefore, a casing for a turbine system capable of more efficiently sharing applied loads of the turbine system would be beneficial. More particularly, an inlet casing capable of more efficiently sharing applied loads between the upper and lower halves of the inlet casing would be particularly useful.

BRIEF DESCRIPTION OF THE INVENTION

Aspects and advantages of the present disclosure will be set forth in part in the following description, or may be apparent from the description, or may be learned through practice of the disclosure.

In one exemplary embodiment of the present disclosure, a turbine system is provided that includes a first turbine casing and a second turbine casing. The second turbine casing is positioned adjacent to the first turbine casing, the first turbine casing and the second turbine casing together defining an inner wall. The turbine system also includes a first attachment assembly configured to attach the second turbine casing to the first turbine casing. The first attachment assembly includes a first attachment flange extending from a surface of the first turbine casing within the inner wall and defining a first aperture. The first attachment assembly also includes a second attachment flange extending from a surface of the second turbine casing within the inner wall, the second attachment flange positioned adjacent to the first attachment flange and defining a second aperture. Additionally, the first attachment assembly includes a pin extending through the first aperture and into the second aperture.

In an exemplary aspect of the present disclosure, a method of assembling a first turbine casing and a second turbine casing in a turbine system is provided. The method includes positioning the second turbine casing adjacent to the first turbine casing, such that the first turbine casing and the second turbine casing together define an inner wall. The first turbine casing includes a first attachment flange extending from a surface of the first turbine casing within the inner wall and the second turbine casing includes a second attachment flange extending from a surface of the second turbine casing within the inner wall. The method also includes aligning a first aperture defined in the first attachment flange with a second aperture defined in a second attachment flange, and inserting a pin into the first aperture and the second aperture.

These and other features, aspects and advantages of the present disclosure will become better understood with reference to the following description and appended claims. The accompanying drawings, which are incorporated in and constitute a part of this specification, illustrate embodiments of the disclosure and, together with the description, serve to explain the principles of the disclosure.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
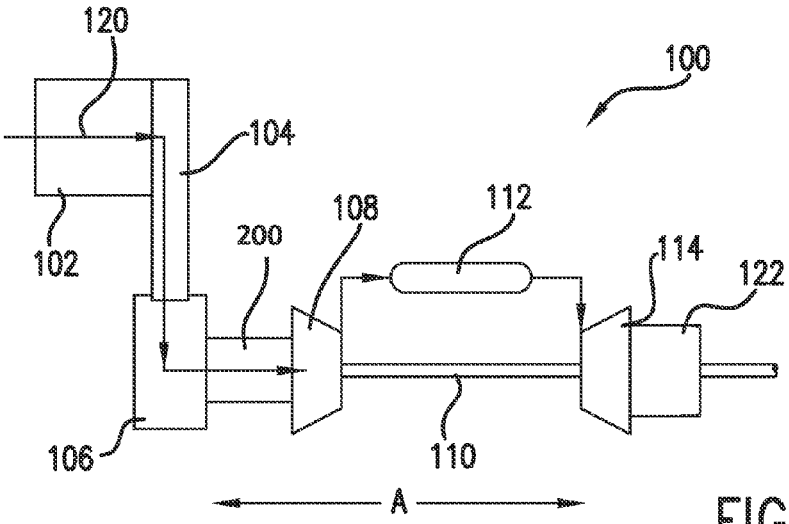
FIG. 1 provides a schematic view of an exemplary turbine system of the present disclosure.

Reference now will be made in detail to embodiments of the disclosure, one or more examples of which are illustrated in the drawings. Each example is provided by way of explanation of the disclosure, not limitation of the disclosure. In fact, it will be apparent to those skilled in the art that various modifications and variations can be made in the present disclosure without departing from the scope or spirit of the disclosure. For instance, features illustrated or described as part of one embodiment can be used with another embodiment to yield a still further embodiment. Thus, it is intended that the present disclosure covers such modifications and variations as come within the scope of the appended claims and their equivalents.

FIG. 1 is a schematic diagram of an exemplary turbine system 100. While the turbine system 100 described herein may generally be a gas turbine system, it should be understood that the turbine system 100 of the present disclosure is not limited to gas turbine systems, and that any suitable turbine system, including but not limited to a steam turbine system, is within the scope and spirit of the present disclosure.

The exemplary system 100 includes a compressor 108, one or more combustors 112, and a turbine 114. The compressor 108 and turbine 114 are coupled by a shaft 110. The shaft 110 may be a single shaft or a plurality of shaft segments coupled together to form shaft 110. The shaft 110 is configured to rotate about an axial direction A of turbine system 100. During operation of the turbine system 100, the compressor section 108 supplies compressed air to the one or more combustors 112. The compressed air is mixed with fuel and burned within each combustor 112 and hot gases of combustion flows through the turbine section 114, wherein energy is extracted from the hot gases to generate power.

Further, the exemplary turbine system 100 of FIG. 1 includes a variety of components configured to flow a working fluid 120 to the power generation components of the system 100, such as the compressor 108, the one or more combustors 112, and the turbine 114. The working fluid 120 may in some exemplary embodiments be air. Alternatively, however, the working fluid 120 may be any fluid suitable for being manipulated in the system 100. The system 100 includes, for example, a filter house 102 configured to accept the working fluid 120 therein. The filter house 102 may include filters and/or other suitable apparatus (not shown) for filtering and cleaning the working fluid 120. The system 100 additionally includes a duct system 104 in fluid communication with the filter house 102. Thus, the working fluid 120 flowing through the filter house 102 flows from the filter house 102 into the duct system 104. The duct system 104 is configured to direct the working fluid 120 therethrough, and towards the power generation components of the system 100. The turbine system 100 further includes a plenum 106 in fluid communication with the duct system 104 and configured to accept the working fluid therein. Thus, the working fluid 120 flowing through the duct system 104 flows from the duct system 104 and into the plenum 106.

The exemplary turbine system 100 also includes an inlet casing 200. The inlet casing 200 is configured to accept the working fluid 120 from the plenum 106, and flow the working fluid 120 therethrough, providing the working fluid 120 to the power generation components of the system 100. For example, as shown schematically in FIG. 1, the inlet casing 200 is configured to flow the working fluid 120 from the plenum 106 to the compressor 108.

In certain embodiments, a guide vane or a plurality of guide vanes (not shown) may be disposed in or adjacent to the inlet casing 200. For example, the guide vane or plurality of guide vanes may be disposed in, e.g., the plenum 106. In such a configuration, the guide vane or plurality of guide vanes may, for example, guide the working fluid 120 into the inlet casing 200 and may reduce the total pressure loss incurred by the working fluid 120 as the working fluid 120 flows into the inlet casing 200 from the plenum 106.

For the exemplary embodiment of FIG. 1, turbine system 100 additionally includes an exhaust casing 122 positioned downstream of turbine section 114. Exhaust casing 122 may be configured to flow the hot combustion gases and/or working fluid 120 from the turbine section 114 to, e.g., one or more exhaust stacks (not shown).

It should be appreciated, however, that in other exemplary embodiments, the turbine system 100 need not include the above various components, and rather that any suitable components for flowing working fluid 120 to or from the power generation components of the system 100 are within the scope and spirit of the present disclosure.

Figure 2:
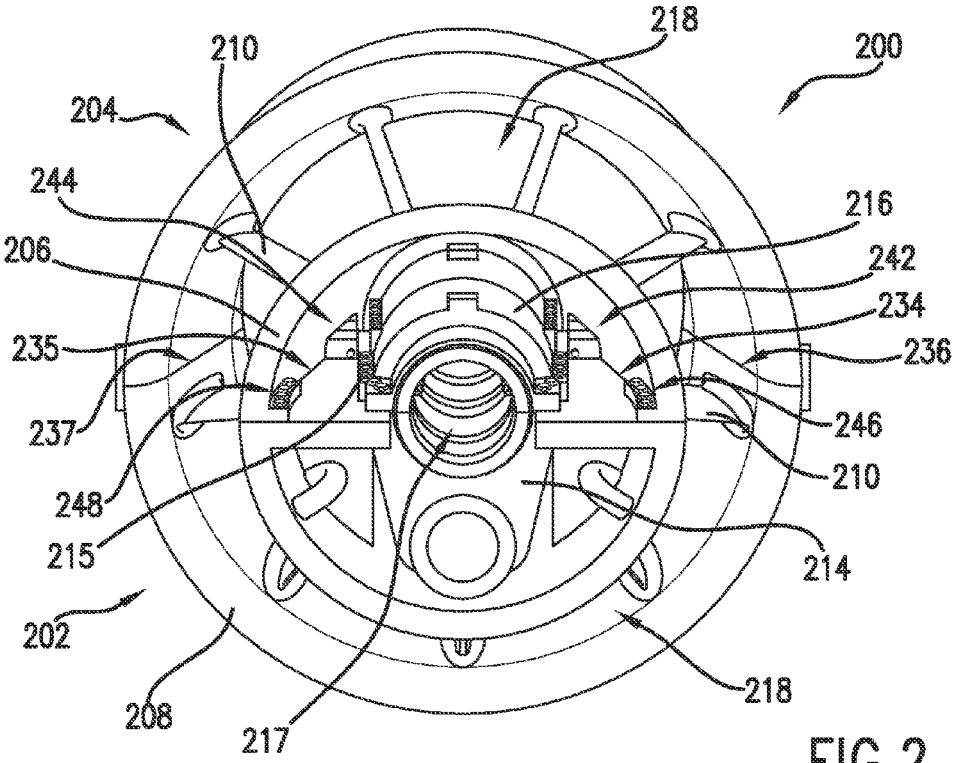
FIG. 2 provides a perspective view of a forward end of an exemplary inlet casing of the present disclosure.
Figure 3:
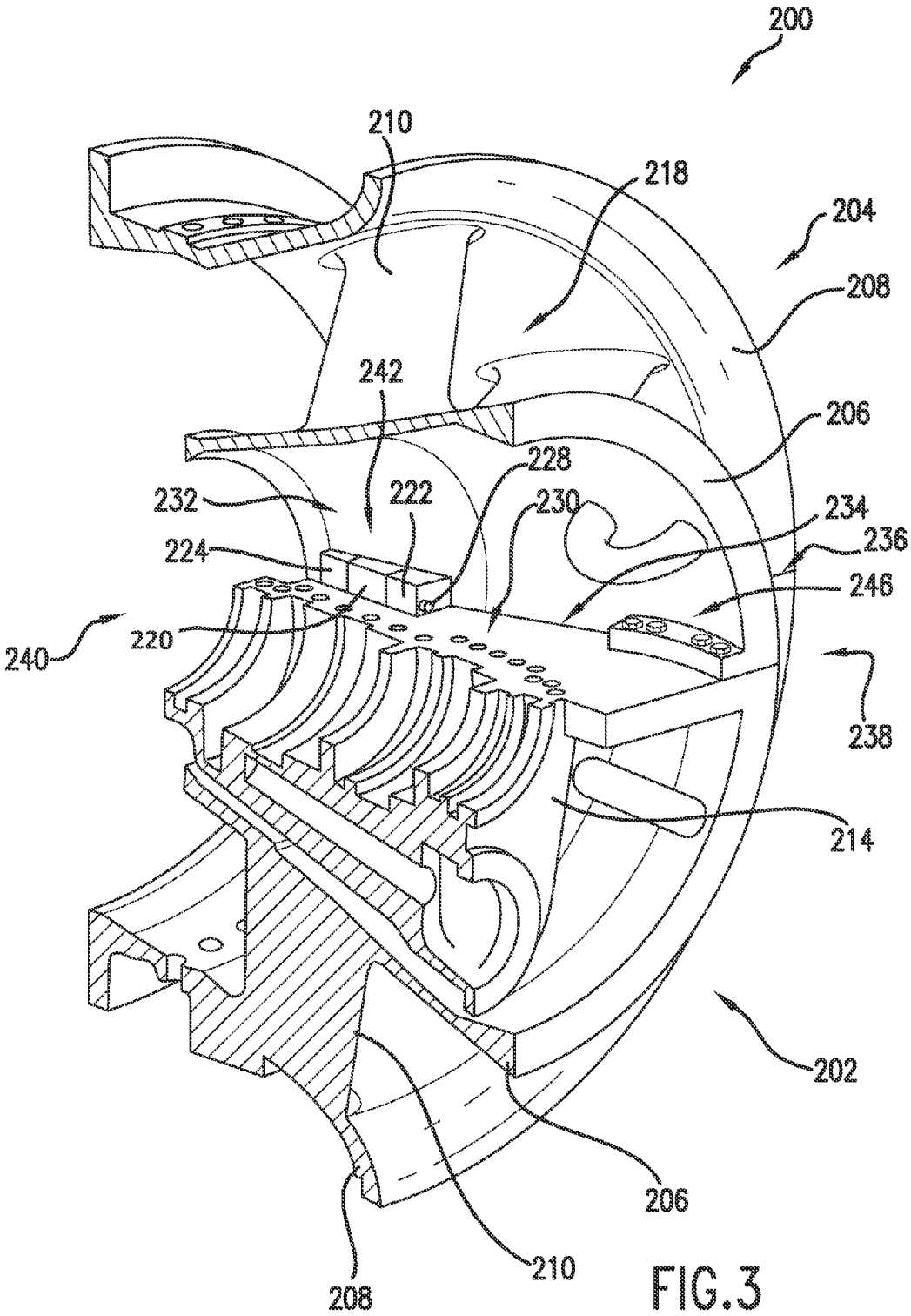
FIG. 3 provides a perspective cross-sectional view of the exemplary inlet casing of FIG. 2.
Figure 4:
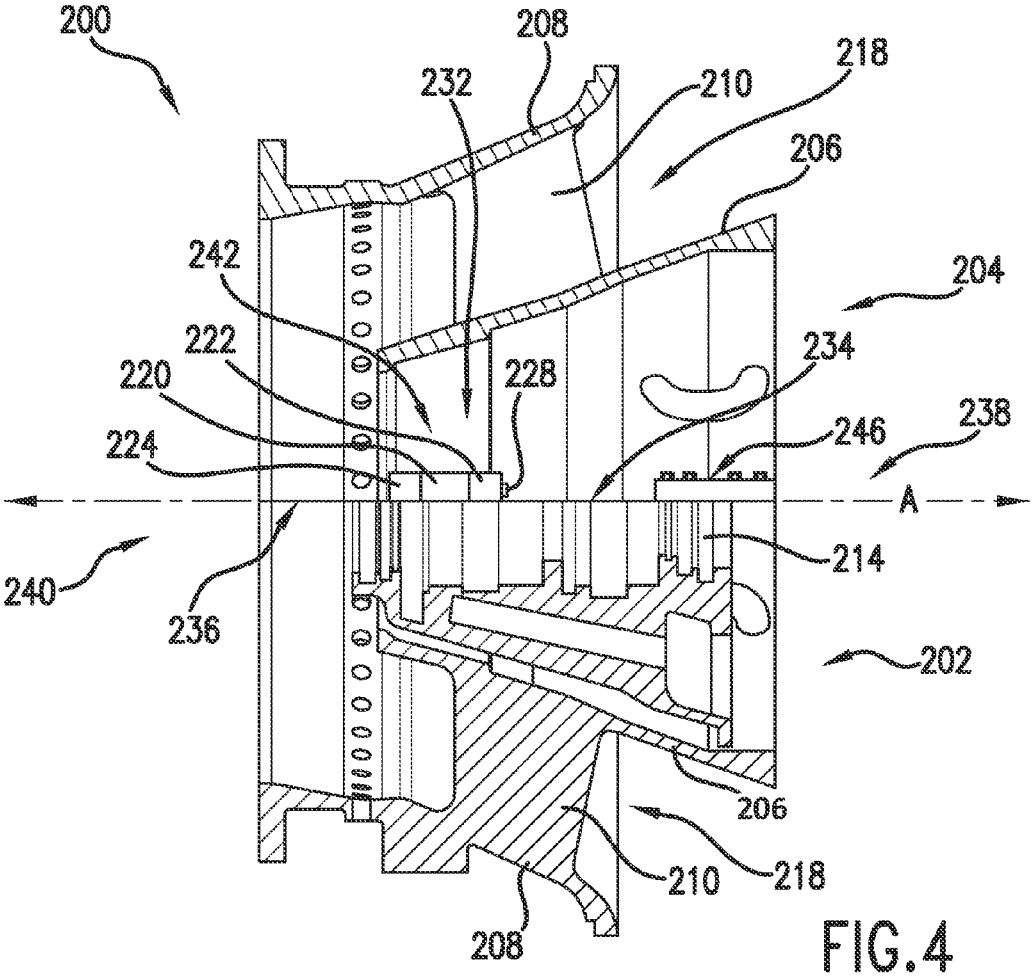
FIG. 4 provides a side cross-sectional view of the exemplary inlet casing of FIG. 2.

Referring now to FIGS. 2, 3, and 4, an exemplary embodiment of an inlet casing 200 of the present disclosure is provided. FIG. 2 provides a perspective view of a forward end 238 of inlet casing 200, FIG. 3 provides a perspective cross-sectional view of inlet casing 200, and FIG. 4 provides a side cross-sectional view of inlet casing 200. FIGS. 3 and 4 are provided without an upper bearing housing 216 positioned therein for clarity.

The exemplary inlet casing 200 is generally constructed by positioning a first turbine casing 202 adjacent to a second turbine casing 204. As shown for the exemplary embodiment of FIGS. 2, 3, and 4, the first turbine casing 202 defines a lower inlet casing and the second turbine casing 204 defines an upper inlet casing. Accordingly, the second turbine casing 204 is positioned on top of the first turbine casing 202 and attached along a plurality of seam lines 234, 235, 236, 237, as discussed below.

Once attached, the first and second turbine casings 202, 204 define an inner wall 206 and an outer wall 208. Additionally, for the exemplary embodiment of FIGS. 2, 3, and 4, inner and outer walls 206, 208 have a generally cylindrical shape that tapers inward from a forward end 238 of the inlet casing 200 to an aft end 240 of the inlet casing 200. Accordingly, the inner and outer walls 206, 208 define a generally annular inlet flow passage 218 therebetween. The inlet flow passage 218 is configured to flow the working fluid 120 from e.g., the plenum 106 to the power generating components of the turbine system 100. In such an embodiment, the inlet casing 200 is configured such that the working fluid 120 flows generally axially downstream through the inlet casing 200 and is further flowed radially inward through at least a portion of the inlet casing 200.

It should be appreciated, however, that in other exemplary embodiments, the inlet casing 200 may have any suitable configuration for flowing the working fluid 120. For example, the first and second turbine casings 202, 204 may be configured side-by-side as opposed to being stacked vertically. Additionally, the inlet flow passage 218 and the inner and outer walls 206, 208 may have any other suitable shape or configuration. For example, in other exemplary embodiments, the inner and outer walls 206, 208 may have any suitable curvilinear shape along the axial direction A.

Still referring to FIGS. 2, 3 and 4, the inner and outer walls 206, 208 are connected by a plurality of inlet struts 210 that provide structural support to the inlet casing 200. As shown, the struts 210 extend through the inlet flow passage 218 between the outer wall 208 and the inner wall 206, and thus may support the inner and outer walls 206, 208. In certain exemplary embodiments, the struts 210 may be arranged in an annular array or in multiple annular arrays in the inlet flow passage 218. Additionally, in other exemplary embodiments, each of the struts 210 may be generally airfoil shaped to allow the working fluid 120 flowing past the struts 210 to flow with a minimal pressure loss. However, it should be understood that the struts 210 of the present disclosure are not limited to the positioning or shapes as disclosed herein, and rather that any suitable struts 210 for providing structural support to the inlet casing 200 are within the scope and spirit of the present disclosure.

Additionally, positioned within inner wall 206 is a bearing housing configured to house the shaft 110. The bearing housing generally includes a lower bearing housing 214 configured within the inner wall 206 and an upper bearing housing 216 (see FIG. 2). The shaft 110 and any associated bearings (not shown) may be positioned in the lower bearing housing 214, and the upper bearing housing 216 may then be attached to the lower bearing housing 214. A plurality of bolts 215 are used to attach the upper bearing housing 216 to the lower bearing housing 214. When constructed, the shaft 110 may extend along the axial direction A through a cylindrical opening 217 defined by the upper and lower bearing housings 216, 214 and through the inner wall 206 of the inlet casing 200. It should be appreciated however, that in other exemplary embodiments, any suitable bearing housing may be provided within the inlet casing 200. For example, in other exemplary embodiments, bearing housings 214, 216 may have any suitable thickness, length, attachment means, etc.

As stated, the first and second turbine casings 202, 204 define a plurality of seam lines 234, 235, 236, 237 oriented substantially along the axial direction A where the first and second turbine casings 202, 204 are joined. The first and second turbine casings 202, 204 define a first and a second seam line 234, 235 where joined to form the inner wall 206, and define a third and a fourth seam line 236, 237 where joined to form the outer wall 208.

In certain embodiments, a plurality of bolts may be used to join the first and second turbine casings 202, 204 along the third and fourth seam lines 236, 237 along an outside surface of outer wall 208 (not shown). Additionally, for the exemplary embodiment of FIGS. 2, 3 and 4, a first bolt assembly 246 and a second bolt assembly 248 are provided inside the inner wall 206 along the first and second seam lines 234, 235, respectively. The first and second bolt assemblies 246, 248 are provided towards the forward end 238 and are configured to attach the first and second turbine casings 202, 204 within the inner wall 206. More particularly, the first and second bolt assemblies 246, 248 are provided along seam lines 234, 235 closer to the forward end 238 than the aft end 240 along the axial direction A. It should be appreciated, however, that along the third and fourth seam lines 236, 237, the first and second turbine casings 202, 204 may be attached by any other suitable means and at any other suitable location. Additionally, any other suitable attachments means may be provided in place of the first and second bolt assemblies 246, 248 towards forward end 238.

Due to the structure of the inner wall 206, however, it may not be suitable to attach the first and second turbine casings 202, 204 within the inner wall 206 towards the aft end 240 using bolt assemblies similar to bolt assemblies 246 and 248. More particularly, as shown, the inner wall 206 tapers inward from the forward end 238 to the aft end 240, such that the generally annular space between the inner wall 206 and the lower and upper bearing housings 214, 216 decreases from the forward end 238 to the aft end 240. Such a configuration may make it difficult for a user to, e.g., operate tools to attach the first and second turbine casings 202, 204 towards the aft end 240 of the inner wall 206 using one or more bolt assemblies. Accordingly, for the exemplary embodiment of FIGS. 2, 3, and 4, a first attachment assembly 242 is positioned along the first seam 234 towards the aft end 240, configured to attach the second turbine casing 204 to the first turbine casing 202, within the inner wall 206. More particularly, for the exemplary embodiment of FIGS. 2, 3, and 4, a first attachment assembly 242 is positioned along the first seam 234 closer to the aft end 240 of the inner wall 206 than the forward end 238 of the inner wall 206.

Figure 5:
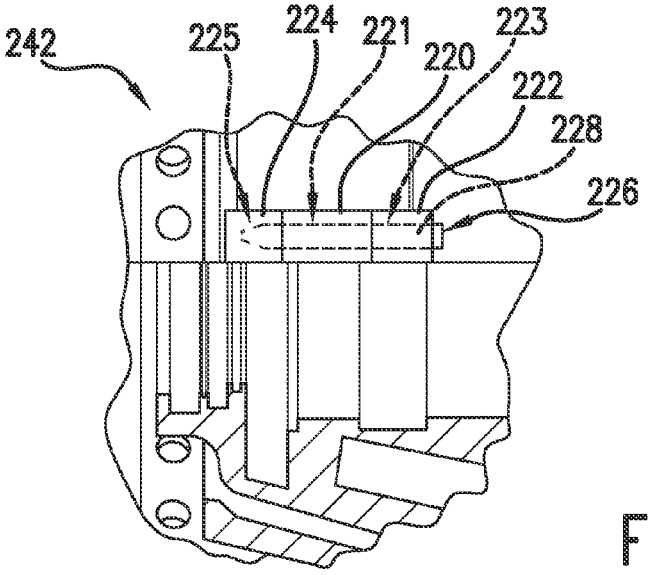
FIG. 5 provides a close-up side view of an exemplary attachment assembly of the present disclosure.

As may be more clearly seen in FIGS. 3 and 4, and the close-up view of FIG. 5, for the exemplary embodiment of FIGS. 2 through 5, first attachment assembly 242 generally includes a first attachment flange 220, a second attachment flange 222, a third attachment flange 224, and a pin 228 extending therethrough. In such an exemplary embodiment, the first attachment flange 220 extends from a surface 230 of the first turbine casing 202 within the inner wall 206, and defines a first aperture 221. Additionally, the second and third attachment flanges 222, 224 extend from a surface 232 of the second turbine casing 204 within the inner wall 206. The second and third attachment flanges 222, 224 define a second aperture 223 and a third aperture 225, respectively. Further, the second and third attachment flanges 222, 224 are each positioned adjacent to the first attachment flange 220, the third attachment flange 224 being positioned on an opposite side of the first attachment flange 220 than the second attachment flange 222. Additionally, the third attachment flange 224 tapers inwards towards surface 232 within the inner wall 206, as shown more clearly in FIG. 3.

In certain exemplary embodiments, the first attachment flange 220 may be comprised of a metal, such as steel, and may be cast along with the first turbine casing 202. Similarly, the second and third attachment flanges 222, 224 may also be comprised of a metal, such as steel, and may be cast along with the second turbine casing 204. It should be appreciated, however, that in other exemplary embodiments, the attachment flanges 220, 222, 224 may be comprised of any other suitable material, and any other suitable means may be used to attach them to the first and second turbine casings 202, 204. For example, in other exemplary embodiments, the attachment flanges may be welded in their respective positions on the first and second turbine casings 202, 204, or may be bolted in their respective positions on the first and second turbine casings 202, 204. However, any other suitable attachment means is considered to be within the scope and spirit of the present disclosure.

The pin 228 and the first, second, and third apertures 221, 223, 225 are shown in phantom in FIG. 5. As shown, the first, second, and third apertures 221, 223, 225 are each aligned, such that the pin 228 may be inserted through the second aperture 223 and into the first aperture 221, and further may be inserted through the first aperture 221 and into the third aperture 225. More particularly, the pin 228 may be inserted into the second aperture 223 from a side of the second attachment flange 222 facing the forward end 238 of the inner wall 206, and then moved towards the aft end 240 of inner wall 206, through the second aperture 223 and into the first aperture 221. The first, second, and third apertures 221, 223, 225 and the pin 228 are oriented substantially along the axial direction A to provide such functionality.

Once inserted, the pin 228 extends through the second aperture 223 and the first aperture 221 and into the third aperture 225. For the exemplary embodiment of FIGS. 2 through 5, the pin 228 is a smooth cylindrical pin with a tapered end and the first, second, and third apertures 221, 223, 225 have a corresponding smooth cylindrical shape. Additionally, for the exemplary embodiment of FIGS. 2 through 5, the pin 228 is sized such that a portion of the pin 228 also remains outside the attachment flanges 220, 222, 224 when fully inserted. More particularly, the pin 228 includes a head portion 226 configured to remain outside second attachment flange 222 when the pin 228 is fully inserted in the first attachment assembly 242. In such an embodiment, the head portion 226 of the pin 228 may, e.g., be configured to receive a locking mechanism to keep pin 228 in position (not shown) or may allow for easy removal by a user.

Exemplary inlet casing 200 of FIGS. 2 through 5 is therefore able to restrict movement of the second turbine casing 204 relative to the first turbine casing 202. Additionally, exemplary inlet casing 200 allows the second turbine casing 204 to more effectively share loads applied to the first turbine casing 202 by, e.g., the shaft 110 and the lower and upper bearing housings 214, 216. More particularly, an applied load on the inner wall 206 is more effectively shared between the inner wall portions of the first turbine casing 202 and the second turbine casing 204, and therefore between the one or more struts 210 connecting the inner wall 206 to the outer wall 208 in the first turbine casing 202 and the second turbine casing 204. Such a construction may reduce the force certain struts 210 are required to tolerate, and therefore may allow certain struts 210 to be designed using less material and having less of an effect on the flow of the working fluid 120 through the inlet air passage 218.

Referring back to the exemplary embodiment of FIG. 2, the inlet casing 200 also includes a second attachment assembly 244 positioned along the second seam line 235 towards the aft end 240. The second attachment assembly 244 is configured and constructed in the same manner as the first attachment assembly 242. For example, the second attachment assembly 244 is positioned along the second seam line 235 towards the aft end 240 and includes a plurality of attachment flanges, with at least one extending from the second turbine casing 204 and at least one extending from the first turbine casing 202, and a pin extending therethrough. More particularly, the second attachment assembly 244 is positioned along the second seam line 235 closer to the aft end 240 of the inner wall 206 than the forward end 238 of the inner wall 206.

Figure 6:
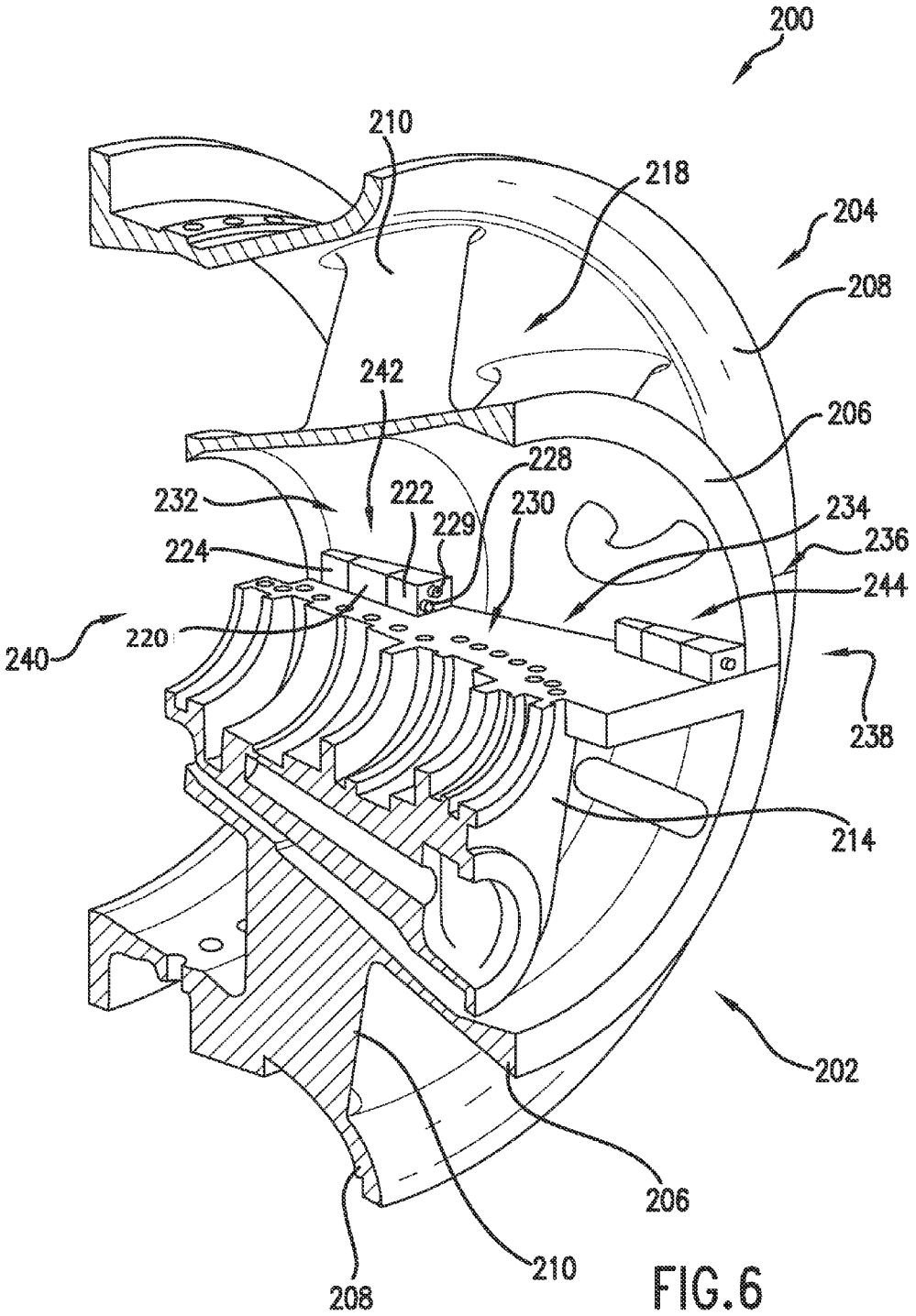
FIG. 6 provides a perspective cross-sectional view of another exemplary inlet casing of the present disclosure.

FIG. 6 provides a perspective cross-sectional view of another exemplary embodiment of the inlet casing 200 of the present disclosure. For the exemplary embodiment of FIG. 6, the first attachment assembly 242 is positioned proximate to the aft end 240 along the first seam line 234 and the second attachment assembly 244 is positioned proximate to the forward end 238 also along the first seam line 234. More particularly, for this exemplary embodiment, the first attachment assembly 242 is positioned closer to the aft end 240 than to the forward end 238, while the second attachment assembly 244 is positioned closer to the forward end 238 than the aft end 240. Such a configuration may allow for the second turbine casing 204 to be more easily attached to the first turbine casing 202.

Additionally, for the exemplary embodiment of FIG. 6, the first attachment assembly 242 further includes an additional set of apertures through the first, second, and third attachment flanges 220, 222, 224 and an additional pin 229 extending therethrough. Similar to the pin 228 and the first, second, and third apertures 221, 223, 225, additional pin 229 extends through a second additional aperture in the second attachment flange 222 and into a first additional aperture in the first attachment flange 220. Further, additional pin 229 extends through the first additional aperture in the first attachment flange 220 and into a third additional aperture in the third attachment flange 224.

It should be appreciated, however, that in other exemplary embodiments, the first and second attachment assemblies 242, 244 may have any other suitable configuration for attaching the first and second turbine casings 202, 204 within the inner wall 206. For example, in other exemplary embodiments, the pin 228 and the first, second, and third apertures 221, 223, 225 can have any other suitable shape or configuration. By way of example, in other exemplary embodiments, the pin 228 may have a threaded portion that corresponds with a similarly threaded portion in one or all of the first, second, and third apertures 221, 223, 225. Alternatively, in other exemplary embodiments, the pin 228 and the first, second, and third apertures 221, 223, 225 may have an ovular or rectangular cross-sectional shape.

It should also be appreciated that in other exemplary embodiments, the first attachment assembly 242 may include any suitable number of attachment flanges, each having any suitable shape, and each having any suitable number of apertures. For example, in other exemplary embodiments of the present disclosure, the first attachment assembly 242 may include two flanges, four flanges, five flanges, etc. Additionally, in any of said embodiments, each attachment flange may have one aperture configured to receive a single pin, or two or more apertures configured to receive two or more pins. Further, although the flanges 220, 222, 224 are shown generally having a squared cross-sectional shape, in other exemplary embodiments the flanges 220, 222, 224 may have any other suitable shape, such as a circular or other rounded cross-sectional shape.

It should further be appreciated that the application of the first and second attachment assemblies 242, 244 is not limited to within the inner wall 206 of the inlet casing 200. For example, an attachment assembly having a similar construction and configuration as the first attachment assembly 242 may be configured to attach a first turbine casing to a second turbine casing elsewhere in the exemplary turbine system 100. By way of example, one or more attachment assemblies of the present disclosure may be positioned instead, or in addition, along one or more seams in the exhaust casing 122 of the exemplary turbine system 100. More particularly, one or more attachment assemblies in accordance with the present disclosure may be configured to attach a first exhaust casing and a second exhaust casing.

This written description uses examples to disclose the invention, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A turbine system defining an axial direction, comprising:

a first turbine casing;

a second turbine casing positioned adjacent to the first turbine casing, the first turbine casing and the second turbine casing together defining an inner wall; and a first attachment assembly configured to attach the second turbine casing to the first turbine casing, the first attachment assembly comprising a first attachment flange extending from a surface of the first turbine casing within the inner wall and defining a first aperture;

a second attachment flange extending from a surface of the second turbine casing within the inner wall, the second attachment flange positioned adjacent to the first attachment flange and defining a second aperture; and a pin extending through the first aperture and into the second aperture, wherein the pin is oriented in substantially the axial direction.

2. The turbine system as in claim 1, wherein the first attachment flange further defines an additional first aperture and the second attachment flange further define an additional second aperture, and wherein the first attachment assembly further comprises an additional pin extending through the additional first aperture and into the additional second aperture.

3. The turbine system as in claim 1, wherein the first attachment assembly further comprises a third attachment flange extending from the surface of the second turbine casing within the inner wall, the third attachment flange positioned adjacent to an opposite side of the first attachment flange and defining a third aperture, and wherein the pin extends through the first aperture and the second aperture and into the third aperture.

4. The turbine system as in claim 3, wherein the third attachment flange tapers into the inside surface of the inner wall.

5. The turbine system as in claim 1, further comprising:

a second attachment assembly configured to attach the second turbine casing to the first turbine casing, the second attachment assembly comprising a third attachment flange extending from a surface of the first turbine casing within the inner wall and defining a third aperture;

a fourth attachment flange extending from a surface of the second turbine casing within the inner wall, the fourth attachment flange positioned adjacent to the third attachment flange and defining a fourth aperture; and a second pin extending through the third aperture and into the fourth aperture.

6. The turbine system as in claim 5, wherein the first and second turbine casings together define a first seam and a second seam, each seam extending along the inner wall, and wherein the first attachment assembly is positioned along the first seam and the second attachment assembly is positioned along the second seam.

7. The turbine system as in claim 5, wherein the first and second turbine casings together define a first seam extending along the inner wall, wherein the first attachment assembly is positioned along the first seam closer to an aft end of the inner wall than a forward end of the inner wall and the second attachment assembly is positioned along the first seam closer to a forward end of the inner wall than an aft end of the inner wall.

8. The turbine system as in claim 1, wherein the first and second turbine casings together further define an outer wall, wherein the inner wall is connected to the outer wall by a plurality of struts.

9. The turbine system as in claim 8, wherein the inner wall and the outer wall each have a generally cylindrical shape that tapers inward from a forward end towards an aft end.

10. The turbine system as in claim 8, wherein the inner wall and the outer wall define a generally annular flow passage for the flow of a working fluid.

11. The turbine system as in claim 8, wherein the first turbine casing is a lower inlet casing and the second turbine casing is an upper inlet casing.

12. The turbine system as in claim 11, further comprising:

a shaft extending through the inner wall, the shaft being positioned in a bearing housing configured within the inner wall.

13. A method of assembling a first turbine casing and a second turbine casing in a turbine system, the turbine system defining an axial direction, the method comprising:

positioning the second turbine casing adjacent to the first turbine casing, such that the first turbine casing and the second turbine casing together define an inner wall, the first turbine casing comprising a first attachment flange extending from a surface of the first turbine casing within the inner wall and the second turbine casing comprising a second attachment flange extending from a surface of the second turbine casing within the inner wall;

aligning a first aperture defined in the first attachment flange with a second aperture defined in a second attachment flange; and inserting a pin through the second aperture and into the first aperture, wherein inserting the pin further comprises moving the pin approximately in the axial direction.

14. The method as in claim 13, wherein inserting the pin further comprises:

inserting the pin into the second aperture from a side of the second attachment flange facing a forward end of the inner wall; and moving the pin towards an aft end of the inner wall, through the second aperture and into the first aperture.

15. The method as in claim 13, wherein the first attachment flange further defines an additional first aperture and the second attachment flange further defines an additional second aperture, and wherein the first attachment assembly further comprises an additional pin extending through the additional first aperture and into the additional second aperture.

16. The method as in claim 13, wherein the second turbine casing further comprises a third attachment flange extending from a surface within the inner wall, the third attachment flange defining an aperture and positioned adjacent to the first attachment flange, and wherein inserting the pin further comprises moving the pin through the apertures in the first and second attachment flanges and into the aperture in the third attachment flange.

17. The method as in claim 13, wherein the first turbine casing is a lower inlet casing and the second turbine casing is an upper inlet casing, and wherein the inner wall has a generally cylindrical shape that tapers inward from a forward end to an aft end.

18. The method as in claim 17, wherein positioning the second turbine casing adjacent to the first turbine casing further comprises:

positioning a shaft in a bottom half of a bearing housing configured within the inner wall of the lower inlet casing; and attaching an upper half of the bearing housing to the lower half of the bearing housing.

19. A turbine system, comprising:

a first turbine casing;

a second turbine casing positioned adjacent to the first turbine casing, the first turbine casing and the second turbine casing together defining an inner wall; and a first attachment assembly configured to attach the second turbine casing to the first turbine casing, the first attachment assembly comprising a first attachment flange extending from a surface of the first turbine casing within the inner wall and defining a first aperture;

a second attachment flange extending from a surface of the second turbine casing within the inner wall, the second attachment flange positioned adjacent to the first attachment flange and defining a second aperture;

a third attachment flange extending from the surface of the second turbine casing within the inner wall, the third attachment flange positioned adjacent to an opposite side of the first attachment flange and defining a third aperture; and a pin extending through the first aperture and the second aperture and into the third aperture.

* * * * *